United States Patent [19]

Heide

[11] 4,341,094

[45] Jul. 27, 1982

[54] CIRCULAR KNITTING NEEDLE

[75] Inventor: Helmut Heide, Menden, Fed. Rep. of Germany

[73] Assignee: Joh. Moritz Rump, Altena, Fed. Rep. of Germany

[21] Appl. No.: 102,949

[22] Filed: Dec. 12, 1979

[30] Foreign Application Priority Data

Dec. 13, 1978 [DE] Fed. Rep. of Germany ..... 2853701

[51] Int. Cl.³ ..... D04B 35/02

[52] U.S. Cl. ..... 66/117; 163/2

[58] Field of Search ..... 66/117, 118; 163/2, 163/5

[56] References Cited

U.S. PATENT DOCUMENTS

| | | | |
|---|---|---|---|
| 2,242,880 | 5/1941 | Dunn | 66/117 |
| 2,620,028 | 12/1952 | Kohut | 163/5 |
| 3,611,551 | 10/1971 | Shave et al. | 163/5 |
| 4,007,610 | 2/1977 | Linstead | 66/117 |

FOREIGN PATENT DOCUMENTS

| | | | |
|---|---|---|---|
| 1585297 | 11/1969 | Fed. Rep. of Germany | 66/117 |
| 3632 | of 1877 | United Kingdom | 66/118 |
| 763792 | 12/1956 | United Kingdom | 66/117 |
| 876144 | 8/1961 | United Kingdom | 66/117 |

*Primary Examiner*—Wm. Carter Reynolds
*Attorney, Agent, or Firm*—Michael J. Striker

[57] ABSTRACT

A circular knitting needle includes two rigid tips interconnected by an intermediate flexible portion. Each of the tips is formed with a projection inserted into an elongated recess formed in each end of the intermediate portion. Each projection is provided with a lug having an outer cylindrical surface and each recess of the intermediate portion has three longitudinal contact surfaces which are in engagement with the outer cylindrical surface of the respective lug.

13 Claims, 8 Drawing Figures

CIRCULAR KNITTING NEEDLE

BACKGROUND OF THE INVENTION

This invention relates to circular knitting needles utilized for various yarns.

It is known in the art, that in the connection between the needle tips and the ends of a flexible intermediate portion of the needle pressing deformations can occur in the ends of the intermediate portion inserted into a recess formed at an end of each tip. Knot-like thickened portions are provided on the end surfaces of the tips which cause tension stresses in the assembly. Polyamide of very high transverse contraction capabilities, a modulus of elasticity which is smaller by 10,000 to 1,000,000 times as compared to steel and with a perfect volumetric stability, has been utilized. However, when the ends of the intermediate portion are clamped within the recess by filling the free volume between the walls of the recess and the end of the flexible portion, the ends of the intermediate portion become elongated along the recess and the initial connection of the knot-like thickened portions with the end surfaces of the tips becomes loosened. The bending stresses can occur in the area of the clamping contact which may cause a strong twisting within the assembly. In the assembly a gap or clearance normally occurs between the knot-like thickened portions and the end surface of the tips in which yarn to be used may be torn.

In order to prevent extension of the polyamide filament from the recess during the assembling it has been suggested to provide the knot-like thickened portions with further thickened elements at the ends thereof. This permitted to form radial pressure forces between said knot-like thickening portions and the ends of the intermediate portion to be inserted into the recess thereby freeing the recess in the direction of its ground. This tends in connection with the inner smooth recesses, that the radial reduction in the ends of the tips and therewith produced deformation of the thickened portions, to produce tension forces in the region of knot-like thickened portions, which during the clamping process remain in the arrangement. They should guarantee that knot-like thickened portions have higher tension stresses at their end surfaces so that in the area of clamping action bending stresses may occur which may prevent construction of the gaps.

The above-described method of manufacturing circular knitting needles in general was reliable, however it may cause discomfort when a diameter of the end of the intermediate portion of the knitting needles surrounded by polyamide filaments has more or less strong allowances within permissible tolerances. It has been particularly observed in such cases that needle tips assembled with the ends of the intermediate portion and having galvanized outer surfaces may be damaged during the forging treatment. Except the problem caused by the defects in tolerances, the needle points in the area adjacent to knot-like thickened portions can overlap the corresponding round outer edges of the outer surfaces of the ends during the forging operation. This can cause catching if the woolen threads are used for knitting.

SUMMARY OF THE INVENTION

It is an object of this invention to avoid defects caused by higher tolerances particularly for polyamide filaments by providing a high end surface quality of the ends of the intermediate portion of the needle and end portions of the tips and to further guarantee such assembling of the inermediate portion which prevents light mesh of wool thread from catching between the intermediate portion and tips.

Another object of this invention is to provide a method of manufacturing circular knitting needle which is economical in use.

These objects are achieved by providing an axial recess with flat contact surfaces to constitute radially inwardly projecting walls and by providing a boring in the recess which is calibrated with a mandrel to obtain allowances exceeding permissible tolerances and to provide sufficient corresponding contact. This arrangement provides a firm cementing position and accelerates tight binding by shortening the period of time or term of hardening of the adhesive material. In order to warrant contact between the end surfaces of the tips and knot-like thickened portions, a pressure 20 to 50 newtons for maximum of five seconds is applied to the ends of the tips and intermediate portion to achieve a firm tightness of the circular knitting needle.

It is an advantage of the present invention to reduce costs in repairing the needles when the tips and intermediate portions are fallen apart during the operation. When the assembly manufactured in accordance with the present invention drops, the danger of damage does not exist any more. Use of defective circular knitting needles could cause constant damage to fabrics to be utilized. The economical effect of utilization of the proposed needle in the massive industry will be increased.

It should be understood as follows from the foregoing that connection between the intermediate portion of the needle and the needle points requires only axial pressures to be exerted thereon, and that further stresses do not occur in the joint, which is important to retain the characteristics of the polyamide, namely its very high transverse contractability and its (compared to steel materials) very small modulus of elasticity. The absence of elongation of the ends of the intermediate portion of the needle leads to an effective improvement in the joints. The knot-like thickened portions thrust against the rounded-off outer edges of the end surfaces of the tips, so that bending stresses induce tension stresses and thereby effectively preclude the development of a gap at the joint.

Although two circumferential surfaces at each recess form sufficient flat contact surfaces, to still more satisfactory cementing contact is provided between the ends of the intermediate portion and tips, as can be seen in the preferred embodiment of the present invention, when the walls of the recess are formed with three contact surfaces which are offset in circumferential direction at an angle of 120° to each other.

In this manner relatively narrow flat surfaces and rounded surfaces are connected to each other, thereby enabling a relatively simple calibrating of flat contact surfaces with a high precision fit. This precision fit provides reliable contacts between the ends of intermediate portion and tips and shortens the term of hand manipulations to obtain a desired tightness thereby resulting in further product development of circular knitting needles.

The narrow longitudinal flat contact surfaces may extend along the whole length of the recess. However, it has been found advantageous when these contact surfaces extend along a major part of the length of the recess to make sufficient allowance for manufacturing tolerance variations in the polyamide filaments. In this connection it is helpful for the contact surfaces to terminate shortly before the aperture of the axial recess where the end surfaces of the ends of intermediate portion terminate.

For convenient insertion of the ends of the intermediate portion into the ends of the tips, the invention suggests that the end surfaces of the ends of the intermediate portion are formed as sloped, wedge-type surfaces. The sloping formed on the end surface may be at an angle 30°–45° with respect to the longitudinal axis of the ends of intermediate portion. A roof-like slope may also be used. By the obtained sloping, the adhesive material is distributed in a clearance provided between the ends of intermediate portion and the walls of the recess.

In this connection it is advantageous to insert the ends of the intermediate portion into the recess with a slight slide fit. This simple insertion of the ends of the intermediate portion provides necessary contact of the ends with contact surfaces for optimizing the cementing effects.

Concerning the diameters with permissible internal allowances of the intermediate portion of circular knitting needles formed of polyamide filament, it should be understood that, as a rule, it is sufficient if the knot-like thickened portions of the ends of the intermediate portion are smooth, i.e., are made cylindrical. In the event of increases in the deviations beyond the permissible tolerances, it has been found advantageous to take additional steps to assure proper contact between the ends of the intermediate portion and the contact surfaces. For this purpose, in accordance with a further feature of the present invention, the ends of the intermediate portion have a thickened portion of e.g., oval form. This can be obtained by a single upsetting operation so that at least two touching points may be obtained. More than two touching surfaces may, however, also be provided which are positioned within several flat surfaces.

In other cases it may be suitable to provide the ends of the inftermediate portion with a plurality of point-like lugs. These touching surfaces may provide two or more contact places along the length of the end of the intermediate portion arranged along the circumferential surface of this end so that a number of contact surfaces of efficient contact is assured in the connection.

In accordance with another embodiment of the present invention to secure reliable contact, the ends of the intermediate portion are provided with annular contact surfaces.

It has been found advantageous to use one-component or two-component adhesive material on the basis of cyanoacrylate or any other conventional suitable basis.

To solve the problem concerning the assembly of the needle, the most advantageous solution has been found in calibrating the contact surfaces formed in the recesses of the tip ends by a mandrel, filling the recess with a quick-binding adhesive material which is distributed in a gap provided between the wall of the recess and the ends of the intermediate portion, and applying to the connection a steady pressure of 20–50 newtons to obtain a firm connection which can withstand separation when the needle is handled. One or two component adhesive material on the basis of cyanocrylate or any other suitable conventional basis may be utilized in this connection.

DESCRIPTION OF THE PREFERRED EMBODIMENTS

Figure 1:
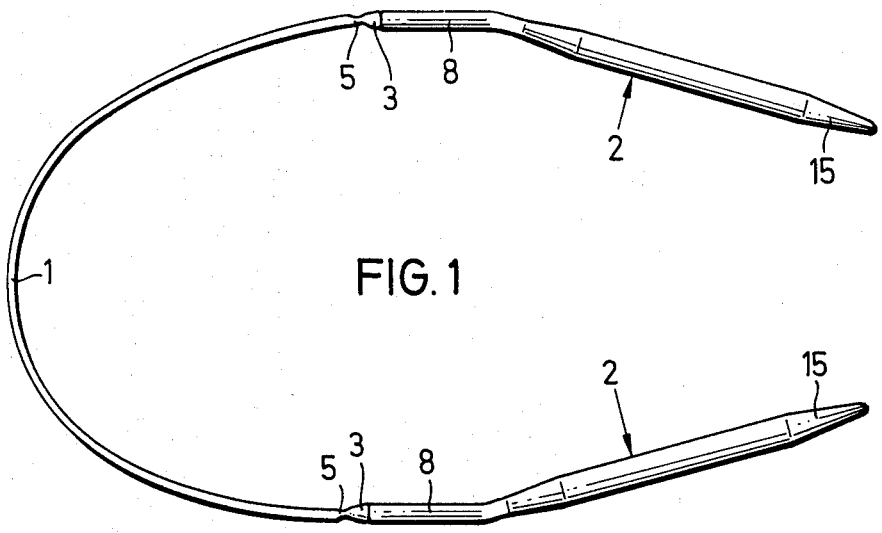
FIG. 1 shows a circular knitting needle having a flexible intermediate portion of the needle and two rigid tips.
Figure 2:
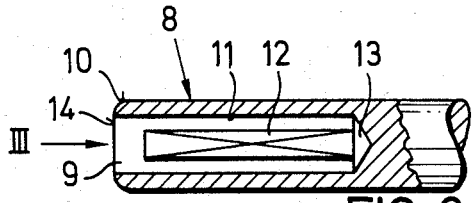
FIG. 2 is an enlarged partially vertical sectional view illustrating a rod portion of the tip which contacts the flexible intermediate portion in accordance with the present invention.
Figure 3:
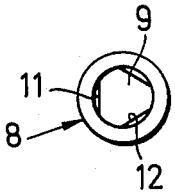
FIG. 3 is a radial sectional view of the rod of FIG. 2 as seen in the direction of arrow III.

Referring now to FIG. 1, a circular knitting needle includes a flexible intermediate part 1 made of solid polyamide filament material and two identical rigid tips 2 made of aluminum which can be galvanized.

Figure 4:
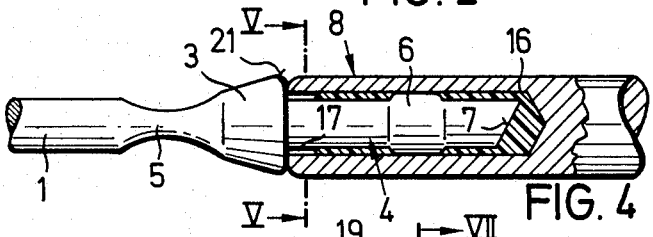
FIG. 4 is a partial sectional view illustrating a contact position between the flexible portion of the needle and the rod portion of the tip.

As can be seen in FIGS. 1 and 4, each end of the flexible intermediate part 1 has a thickened portion 3 provided with an axially extending projection 4. Immediately after the thickening portion 3 a transverse thin area 5 is disposed between portion 3 and the remaining portion of the flexible part 1.

As shown in FIG. 4, each end of the intermediate part is terminated with the projection 4 which includes approximately at the middle thereof an annular lug 6. Lug 6 is formed of a length somewhat longer than the diameter of the projection 4. An elongated portion of projection 4 has an end terminated by a front surface 7, which may be a slant surface. The front surface 7 may be sloped at an angle of 30° to the longitudinal axis of the projection 4. At each end of the rigid tip 2 an axial recess 9 is formed to receive the extended projection 4 having a circular cross-section. This recess 9 may be obtained, for example, by boring. The outer sharp edges 10 of the projection 4 are rounded off. The recess is calibrated with a mandrel so that the walls 11 are formed with three contact surfaces 12 of the recess which are circumferentially offset at an angle of 120°, thus providing longitudinal contact surfaces 12 which extend radially inwardly. The contact surfaces 12 extend from area 13 of the recess 9 to the front surface of the rod portion 8 of the tip.

For manufacturing of the circular knitting needle, needle points 15 are ground and the shafts 8 are thereafter formed to the desired shape without removal of material. The ends of the tips are cut off to a desired length and provided with recesses 9. Parallel to this fabrication the ends of the intermediate part 1 are provided with knot-like thickened portions 3 and with the lugs 6 respectively. The tips 2 are then further ground, polished and galvanized.

Figure 5:
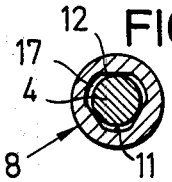
FIG. 5 is a sectional view taken along line V—V of FIG. 4.

For assembling the intermediate part, with tips 2, as can be seen in FIGS. 4 and 5, a quick-binding one-component adhesive material 16 on the basis of cyanoacrylate, is utilized which is inserted into recess 9 and holds projection 4 of the end of intermediate part 1 in connection with the tip. Upon insertion a toroidal lug 6 is in touching contact with the contact surfaces 12. The sloped front surface 7 of the projection 4 will displace and distribute the adhesive material 16 in a clearance 17 between the outer surface of the projection 4 and the walls 11 along the shorter aperture of the recess 9. A temporary steady (non-shaking) pressure of a magnitude of 20 to 50 newtons is applied for a maximum of 5 seconds to the contact surfaces of the projection 4 and end portion of the tip 2 until sufficient bonding is obtained for the needle to withstand handling. The final strength provided by the described method will be achieved in approximately 12 hours. The strength achieved by the present method is of the magnitude of 10 to 30 kilopounds.

Figure 6:
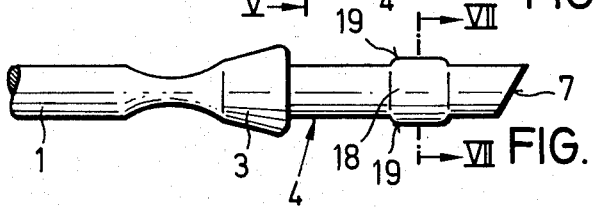
FIG. 6 is an enlarged partial view illustrating another embodiment of the present invention.
Figure 7:
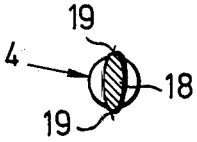
FIG. 7 is an enlarged sectional view taken along line VII—VII of FIG. 6.

The annular lug 6 seen in FIG. 4, which is in continuous contact with the contact surfaces 12 is replaced with an oval cross-section 18 as shown in FIGS. 6 and 7, illustrating the second embodiment of the present invention. Such structure provides a reliable contact between outer surfaces 19 of a lug or thickened portion 18 and the contact surfaces of the recess 9.

Figure 8:
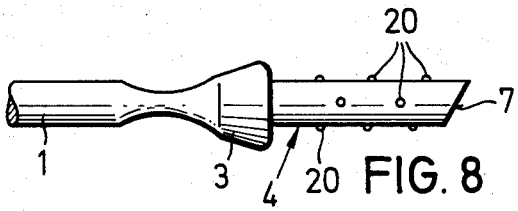
FIG. 8 illustrates a third embodiment of the present invention.

FIG. 8 illustrates a third embodiment of the present invention. A plurality of lugs 20 are formed on the outer surface of the projection 4 to obtain a plurality of additional contact surfaces between projection 4 and the end portion 8 of tip 4.

The lugs or thickened portions 6, 18, 20 provided on the outer surface of the projection 4 are particularly suitable when the dimensional deviations of the polyamide filament are higher than the permissible tolerances. When the deviation is within or less than the permissible tolerances the lugs 6, 18, 20 may be omitted. In that case, only the cylindrical projections 4 are used.

As is depicted in FIGS. 1 and 4, the rounded-off outer edges 10 provided on the end of the tip 2 suitably match rounded-off edges 21 formed on the thickened portions 3 of the flexible needle part end so that knit and wool yarn used in the knitting can readily slide over and will never be stuck between the intermediate part of the needle and needle tips.

Modifications and variations of the above-described preferred embodiments may become evident to one skilled in the art in light of the above teachings. It is to be understood that variations may be made to the preferred embodiments without departing from the spirit and scope of the invention as defined in the appended claims.

I claim:

1. A circular knitting needle, comprising a flexible intermediate portion of a viscous polyamide filament material and two rigid tips connected to said intermediate portion, each of said tips including a rod portion and a needle point, said rod portion being formed with an axial recess which is filled with a quick-binding adhesive material, said intermediate portion including an axially extending projection at each end thereof which is inserted into a respective recess so that said adhesive material surrounds said projection, said projection being formed with at least one radially outwardly projecting lug, said lug having an outer cylindrical surface, said recess being formed with at least two longitudinal contact surfaces extending radially inwardly from an inner surface thereof, said contact surfaces being in engagement with the outer cylindrical surface of said lug to provide a reliable contact between said recess and said projection.

2. The circular knitting needle of claim 1, wherein said intermediate portion includes a thickened section at each end thereof formed intermediate between said projection and the remaining part of said intermediate portion.

3. The circular knitting needle of claim 2, wherein each said thickened section is a knot-like member.

4. The circular knitting needle of claim 3, wherein each said knot-like member has a rounded-off outer edge.

5. The circular knitting needle of claim 4, wherein said rod portion of each said tip is provided with a rounded-off outer edge, said outer edge of said rod portion of the tip being arranged in adjacent relation to said outer edge of said knot-like member to prevent the sticking of a yarn to be used between said intermediate portion and said tip.

6. The circular knitting needle of claim 1, wherein said longitudinal contact surfaces are three surfaces disposed at an angle 120° to form said contact walls.

7. The circular knitting needle of claim 1, wherein said contact surfaces extend axially along an essential portion of said axial recess.

8. The circular knitting needle of claim 1, wherein each said projection is formed with an end having a sloped surface thereof.

9. The circular knitting needle of claim 1, wherein each said projection is slideably inserted into said recess respectively.

10. The circular knitting needle of claim 1, wherein each said lug is oval in its cross-section.

11. The circular knitting needle of claim 1, wherein each said lug is an annular member.

12. The circular knitting needle of claim 1, wherein said adhesive material is a one component adhesive material on a basis of cyanoacrylate.

13. The circular knitting needle of claim 1, wherein said adhesive material is a two-component adhesive material on a basis of cyanoacrylate.

* * * * *